US006438897B1

(12) United States Patent
Weder et al.

(10) Patent No.: US 6,438,897 B1
(45) **Date of Patent: *Aug. 27, 2002**

(54) SLEEVE WITH TRAPEZOIDAL LOWER END

(75) Inventors: Donald E. Weder; Joseph G. Straeter, both of Highland, IL (US); Paul Fantz, Imperial, MO (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/851,171

(22) Filed: May 8, 2001

Related U.S. Application Data

(63) Continuation-in-part of application No. 09/401,771, filed on Sep. 22, 1999, now Pat. No. 6,230,441, which is a continuation of application No. 08/606,957, filed on Feb. 26, 1996, now abandoned.

(51) Int. Cl.[7] ..... A47G 7/08; A47G 7/02
(52) U.S. Cl. ..... 47/72
(58) Field of Search ..... 47/72, 41.01

(56) References Cited

U.S. PATENT DOCUMENTS

| | | | |
|---|---|---|---|
| 524,219 | A | 8/1894 | Schmidt |
| 732,889 | A | 7/1903 | Paver |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 345464 | 12/1921 |
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2610604 | 8/1988 |
| FR | 2603159 | 3/1989 |
| FR | 2619698 | 3/1989 |
| GB | 5605 | 5/1885 |
| GB | 1204647 | 9/1970 |
| GB | 2056410 | 3/1981 |

(List continued on next page.)

OTHER PUBLICATIONS

Speed Cover Brochure, "The Simple Solution For Those Peak Volume Periods", Highland Supply Corporation, ©1989.

(List continued on next page.)

*Primary Examiner*—Peter M. Poon
*Assistant Examiner*—Jeffrey L. Gellner
(74) *Attorney, Agent, or Firm*—Dunlap, Codding & Rogers, P.C.

(57) ABSTRACT

A floral sleeve initially having a flattened condition and openable therefrom for use in covering, containing or wrapping a floral grouping, botanical item, pot, or pot having a floral grouping or botanical item therein. The sleeve has a trapezoidal lower end, and may have a detachable upper portion. The sleeve may have a non-linear or linear upper edge. When having a detachable upper portion, the sleeve has a detaching element which when employed, to detach the upper portion, leaves a linear, or non-linear upper edge on the lower portion of the sleeve. The trapezoidal lower end of the sleeve may have a gusset therein.

41 Claims, 4 Drawing Sheets

U.S. PATENT DOCUMENTS

| | | | | |
|---|---|---|---|---|
| 950,785 | A | 3/1910 | Pene | |
| 1,044,260 | A | 11/1912 | Schloss | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | 229/87 |
| 1,794,212 | A | 2/1931 | Snyder | |
| 1,811,574 | A | 6/1931 | Barrett | |
| 1,863,216 | A | 6/1932 | Wordingham | |
| 1,978,631 | A | 10/1934 | Herrlinger | 91/68 |
| 2,048,123 | A | 7/1936 | Howard | 229/87 |
| 2,140,932 | A | * 12/1938 | Avery | 47/72 |
| RE21,065 | E | 5/1939 | Copeman | 93/2 |
| 2,170,147 | A | 8/1939 | Lane | 206/56 |
| 2,200,111 | A | 5/1940 | Bensel | 229/1.5 |
| 2,278,673 | A | 4/1942 | Savada et al. | 154/43 |
| 2,302,259 | A | 11/1942 | Rothfuss | 41/10 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,411,328 | A | 11/1946 | MacNab | 33/12 |
| 2,510,120 | A | 6/1950 | Leander | 117/122 |
| 2,529,060 | A | 11/1950 | Trillich | 117/68.5 |
| 2,621,142 | A | 12/1952 | Wetherell | 154/117 |
| 2,648,487 | A | 8/1953 | Linda | 229/55 |
| 2,688,354 | A | 9/1954 | Berger | 150/28 |
| 2,774,187 | A | 12/1956 | Smithers | 47/41 |
| 2,822,287 | A | 2/1958 | Avery | 117/14 |
| 2,846,060 | A | 8/1958 | Yount | 206/58 |
| 2,850,842 | A | 9/1958 | Eubank, Jr. | 47/58 |
| 2,883,262 | A | 4/1959 | Borin | 21/56 |
| 2,989,828 | A | 6/1961 | Warp | 53/390 |
| 3,022,605 | A | 2/1962 | Reynolds | 47/58 |
| 3,080,680 | A | 3/1963 | Reynolds | 47/37 |
| 3,094,810 | A | 6/1963 | Kalpin | 47/37 |
| 3,121,647 | A | 2/1964 | Harris et al. | 118/202 |
| 3,130,113 | A | 4/1964 | Silman | 161/97 |
| 3,271,922 | A | 9/1966 | Wallerstein et al. | 53/3 |
| 3,322,325 | A | 5/1967 | Bush | 229/62 |
| 3,376,666 | A | 4/1968 | Leonard | 47/41 |
| 3,380,646 | A | 4/1968 | Doyen et al. | 229/57 |
| 3,431,706 | A | 3/1969 | Stuck | 53/390 |
| 3,508,372 | A | 4/1970 | Wallerstein et al. | 53/3 |
| 3,510,054 | A | 5/1970 | Sanni et al. | 229/66 |
| 3,512,700 | A | 5/1970 | Evans et al. | 229/53 |
| 3,550,318 | A | 12/1970 | Remke et al. | 47/37 |
| 3,552,059 | A | 1/1971 | Moore | 47/41.12 |
| 3,554,434 | A | 1/1971 | Anderson | 229/55 |
| 3,556,389 | A | 1/1971 | Gregoire | 229/53 |
| 3,557,516 | A | 1/1971 | Brandt | 53/14 |
| 3,620,366 | A | 11/1971 | Parkinson | 206/59 |
| 3,681,105 | A | 8/1972 | Milutin | 117/15 |
| 3,767,104 | A | 10/1973 | Bachman et al. | 229/7 |
| 3,793,799 | A | 2/1974 | Howe | 53/32 |
| 3,869,828 | A | 3/1975 | Matsumoto | 47/34.11 |
| 3,888,443 | A | 6/1975 | Flanigen | 248/152 |
| 3,962,503 | A | 6/1976 | Crawford | 428/40 |
| 4,043,077 | A | 8/1977 | Stonehocker | 47/66 |
| 4,054,697 | A | 10/1977 | Reed et al. | 428/40 |
| 4,091,925 | A | 5/1978 | Griffo et al. | 206/423 |
| 4,113,100 | A | 9/1978 | Soja et al. | 206/602 |
| 4,118,890 | A | 10/1978 | Shore | 47/28 |
| 4,189,868 | A | 2/1980 | Tymchuck et al. | 47/84 |
| 4,216,620 | A | 8/1980 | Weder et al. | 47/72 |
| 4,248,347 | A | 2/1981 | Trimbee | 206/423 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,297,811 | A | 11/1981 | Weder | 47/72 |
| 4,333,267 | A | 6/1982 | Witte | 47/84 |
| 4,347,686 | A | 9/1982 | Wood | 47/73 |
| 4,380,564 | A | 4/1983 | Cancio et al. | 428/167 |
| 4,400,910 | A | 8/1983 | Koudstall et al. | 47/84 |
| 4,413,725 | A | 11/1983 | Bruno et al. | 206/45.33 |
| D279,279 | S | 6/1985 | Wagner | D11/143 |
| 4,546,875 | A | 10/1985 | Zweber | 206/0.82 |
| 4,621,733 | A | 11/1986 | Harris | 206/423 |
| 4,640,079 | A | 2/1987 | Stuck | 53/390 |
| 4,717,262 | A | 1/1988 | Roen et al. | 383/120 |
| 4,733,521 | A | 3/1988 | Weder et al. | 53/580 |
| 4,765,464 | A | 8/1988 | Ristvedt | 206/0.82 |
| 4,771,573 | A | 9/1988 | Stengel | 47/67 |
| 4,773,182 | A | 9/1988 | Weder et al. | 47/72 |
| 4,801,014 | A | 1/1989 | Meadows | 206/423 |
| 4,810,109 | A | 3/1989 | Castel | 383/105 |
| 4,835,834 | A | 6/1989 | Weder | 29/525 |
| D301,991 | S | 7/1989 | Van Sant | D11/149 |
| 4,941,572 | A | 7/1990 | Harris | 206/423 |
| 4,980,209 | A | 12/1990 | Hill | 428/34.1 |
| 4,989,396 | A | 2/1991 | Weder et al. | 53/397 |
| D315,700 | S | 3/1991 | Stephens | D11/151 |
| 5,073,161 | A | 12/1991 | Weder et al. | 493/154 |
| 5,074,675 | A | 12/1991 | Osgood | 383/122 |
| 5,105,599 | A | 4/1992 | Weder | 53/399 |
| 5,111,638 | A | 5/1992 | Weder | 53/397 |
| 5,120,382 | A | 6/1992 | Weder | 156/212 |
| 5,152,100 | A | 10/1992 | Weder et al. | 47/72 |
| 5,181,364 | A | 1/1993 | Weder | 53/397 |
| D335,105 | S | 4/1993 | Ottenwalder et al. | D11/164 |
| 5,199,242 | A | 4/1993 | Weder et al. | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,239,775 | A | 8/1993 | Landau | 47/72 |
| 5,249,407 | A | 10/1993 | Stuck | 53/399 |
| 5,259,106 | A | 11/1993 | Weder et al. | 29/469.5 |
| 5,307,606 | A | 5/1994 | Weder | 53/410 |
| 5,315,785 | A | 5/1994 | Avôt et al. | 47/72 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,428,939 | A | 7/1995 | Weder et al. | 53/397 |
| 5,443,670 | A | 8/1995 | Landau | 156/191 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,551,570 | A | 9/1996 | Shaffer et al. | 206/575 |
| 5,572,849 | A | 11/1996 | Weder et al. | 53/399 |
| 5,572,851 | A | 11/1996 | Weder | 53/399 |
| 5,575,133 | A | 11/1996 | Weder et al. | 53/397 |
| 5,617,703 | A | 4/1997 | Weder | 53/413 |
| 5,624,320 | A | 4/1997 | Martinez | 472/51 |
| 5,625,979 | A | 5/1997 | Weder | |
| 5,647,168 | A | 7/1997 | Gilbert | 47/72 |
| 5,647,193 | A | 7/1997 | Weder et al. | 53/465 |
| 5,715,944 | A | 2/1998 | Windisch | 206/423 |
| D404,684 | S | 1/1999 | Shea | D11/164 |
| D419,436 | S | 1/2000 | Celtorius et al. | D9/305 |
| 6,129,209 | A | 10/2000 | Tchira | 206/423 |
| 6,182,395 | B1 * | 2/2001 | Weder et al. | 47/72 |
| 6,185,904 | B1 * | 2/2001 | Weder et al. | 47/72 |
| 6,230,441 | B1 * | 5/2001 | Weder et al. | 74/72 |
| 6,298,601 | B1 * | 10/2001 | Weder et al. | 47/72 |
| 2001/0000555 | A1 * | 5/2001 | Weder et al. | 47/72 |

FOREIGN PATENT DOCUMENTS

| | | |
|---|---|---|
| GB | 2074542 | 11/1981 |
| GB | 2128083 | 4/1984 |
| GB | 2252708 | 8/1992 |
| IT | 224507 | 4/1996 |
| JP | 542958 | 2/1993 |
| NL | 8301709 | 12/1984 |
| NL | 1000658 | 1/1996 |
| WO | 9315979 | 8/1993 |

OTHER PUBLICATIONS

"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.
"Halloween", Link Magazine, sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec. 1996, 2 pages.
"Derwent Abstract" of FR 2610604A. It is noted that the abstract is an incorrect English translation of the contents of the French patent. The French patent does not enable or disclose adhesively attaching the covering to the container. 1988.
"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon the neck of the vase.
"Special Occasion Printed Highlophane Bags" Brochure, Highland Supply Corporation, 1990, 2 pages.
"Creative Packaging" Brochure, John Henry Company, Sep. 1992.
"Make Highlander Your Headquarters" Brochure, Highland Supply Corporation, 1991.

* cited by examiner

SLEEVE WITH TRAPEZOIDAL LOWER END

CROSS REFERENCE TO RELATED APPLICATIONS

The present application is a continuation-in-part of U.S. Ser. No. 09/401,771, filed Sep. 22, 1999, now U.S. Pat. No. 6,230,441 which is a continuation of U.S. Ser. No. 08/606, 957, filed Feb. 26, 1996, now abandoned.

FIELD OF THE INVENTION

This invention generally relates to sleeves, and more particularly, to sleeves used to wrap floral groupings or flower pots containing floral groupings and/or mediums containing floral groupings, and methods of using same. U.S. Pat. Nos. 5,625,979 and 5,493,809 and pending U.S. Ser. No. 09/189,033 disclose subject matter which may be relevant to the invention contemplated and claimed herein and are hereby expressly incorporated herein by reference in their entirety.

DESCRIPTION OF THE PREFERRED EMBODIMENTS

Figure 1:
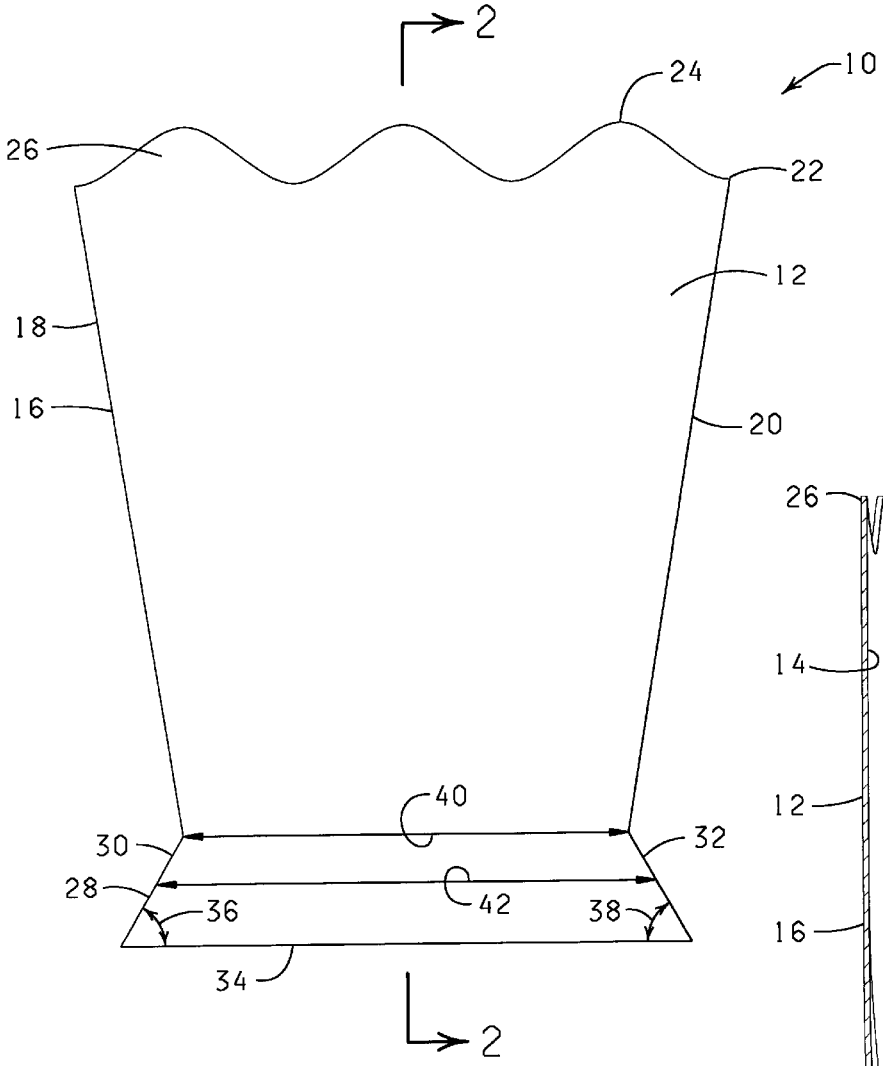
FIG. 1 is an elevational view of a sleeve constructed in accordance with the present invention.
Figure 2:
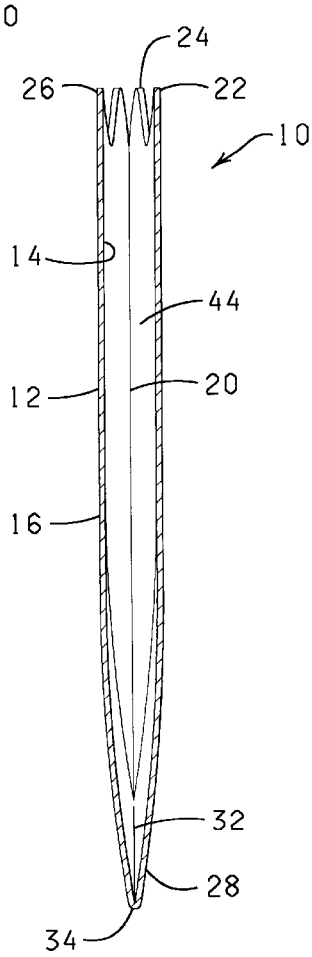
FIG. 2 is a cross-sectional view of the sleeve of FIG. 1 taken along line 2—2.
Figure 3:
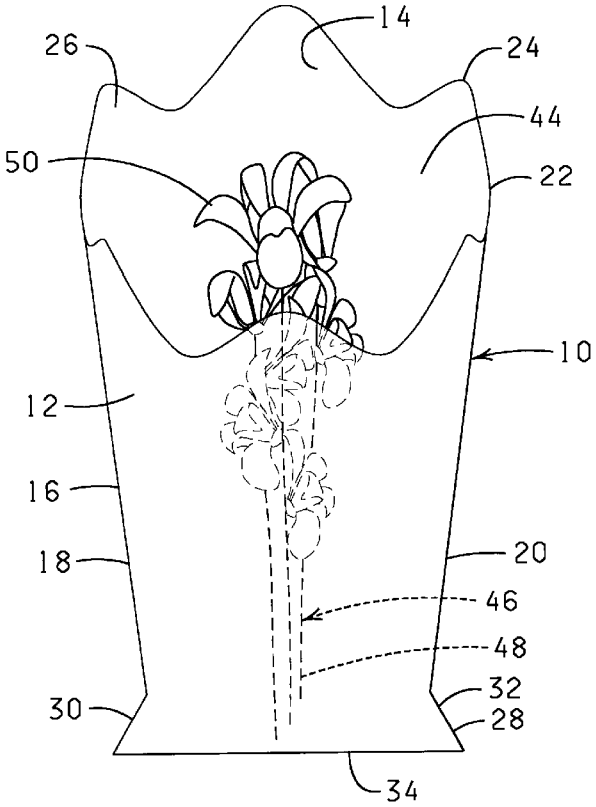
FIG. 3 is a perspective view of a sleeve such as the sleeve in FIG. 1 having a floral grouping therein.

The present invention contemplates in a preferred version a preformed sleeve (also referred to herein as a "floral sleeve" or simply as "a sleeve") having a tubular shape sized to contain and conform to a flower pot having an upper end, a lower end and an outer peripheral surface. The sleeve may further comprise a detachable upper portion which may be sized to surround and encompass a floral grouping.

The sleeve may form part of a plant package when used in conjunction with a floral grouping or a pot having a floral grouping therein, and wherein the pot and/or floral grouping is substantially surrounded and encompassed by the sleeve. The floral grouping is at least partially surrounded and encompassed and may be entirely enclosed by the upper portion when it forms a part of the sleeve.

Also, the sleeve may have a bonding material disposed on an inner portion thereof for bondingly connecting to a pot disposed therein. Alternatively, the bonding material may be disposed on an outer portion of the sleeve for forming a plurality of crimps in a portion of the sleeve.

When present, the lower portion of the sleeve may be constructed from a first material and the upper portion (when present) may be constructed from the first material or a second material different from the first material.

These embodiments and others of the present invention are now described in more detail below. It will be appreciated that the examples provided herein are not intended to limit the scope and extent of the claimed invention but are only intended to exemplify various embodiments of the invention contemplated herein.

Shown in FIGS. 1–4 is a sleeve designated by the general reference numeral 10. Sleeve 10 has an outer peripheral surface 12, an inner peripheral surface 14, a body 16, a first sidewall edge 18, a second sidewall edge 20, an upper end 22 having an upper edge 24, a skirt portion 26, a trapezoidal lower end 28 and an inner space 44. The trapezoidal lower end 28 has a first lower side edge 30, a second lower side edge 32, and a bottom edge 34. The first lower side edge 30 forms a first angle 36 with the bottom edge 34 and the second lower side edge 32 forms a second angle 38 with the bottom edge 34. The first angle 36 and the second angle 38 face each other and are each less than 90°. The sleeve 10 has a minimum width 40 in the body 16 thereof and a width 42 in the trapezoidal lower end 28 thereof. The minimum width 40 of the body 16 is less than the width 42 of the trapezoidal lower end 28. The sleeve 10 is preferably individually sized so that a standard sized flower pot, such as a 3-inch, 3½-inch, 4-inch, 4½-inch, 5-inch, 5½-inch, 6-inch, 6½-inch, 7-inch or 8-inch pot, for example, can fit within the sleeve 10, with the pot preferably substantially conforming to the inner peripheral surface 14 of the sleeve 10. The body 16 of the sleeve 10 preferably has a tapered, frustoconical shape, but may also have a rectangular or cylindrical shape. The sleeve 10 is initially formed to have a flattened condition and is openable therefrom to an open state for containing a floral container such as a pot as described elsewhere herein.

In a preferred version of sleeve 10, the first angle 36 and second angle 38 are each in a range of from about 85° to about 5°, or from about 80° to about 10°, or from about 75° to about 15°, or from about 70° to about 20°, or from about 65° to about 25° , or from about 60° to about 30°, or from about 55° to about 35°, or from about 50° to about 40°, or from about 48° to about 42°, and preferably are about 45°.

Figure 4:
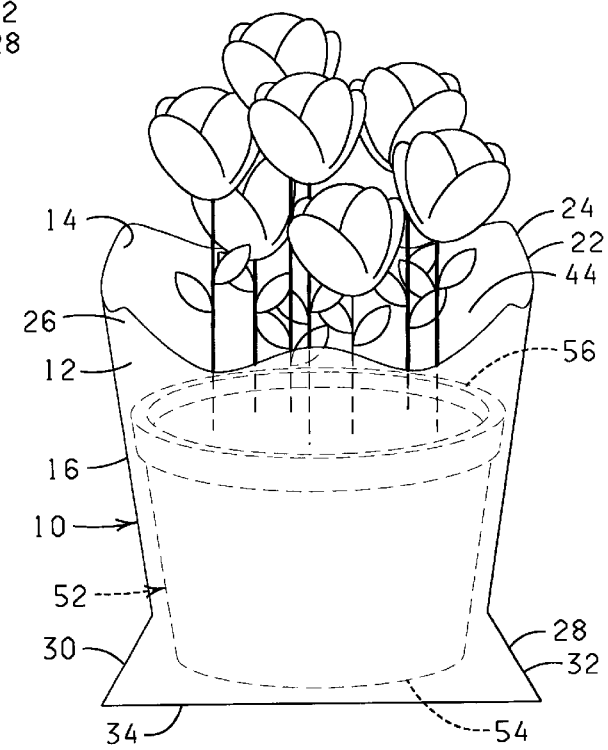
FIG. 4 is a perspective view of the sleeve of FIG. 1 having a pot and floral grouping therein.

In a preferred version of the invention shown in FIGS. 1–4, the upper edge 24 of the upper end 22 of the sleeve 10 has a non-linear pattern such as a curve, wave, or serration. The upper edge 24 and the upper end 22 form the skirt portion 26 of the sleeve 10 for decorating a floral grouping 46 having a stem portion 48 and a bloom portion 50 disposed therein (FIG. 3) or a pot 52 having a lower end 54 and an upper end 56 (FIG. 4). Other non-linear configurations of the upper edge 24 of the skirt portion 26 will be readily apparent to one of ordinary skill in the art, for example, those shown in FIGS. 11–16 of U.S. Ser. No. 09/401,771, the entire specification of which is hereby expressly incorporated herein by reference.

Figure 5:
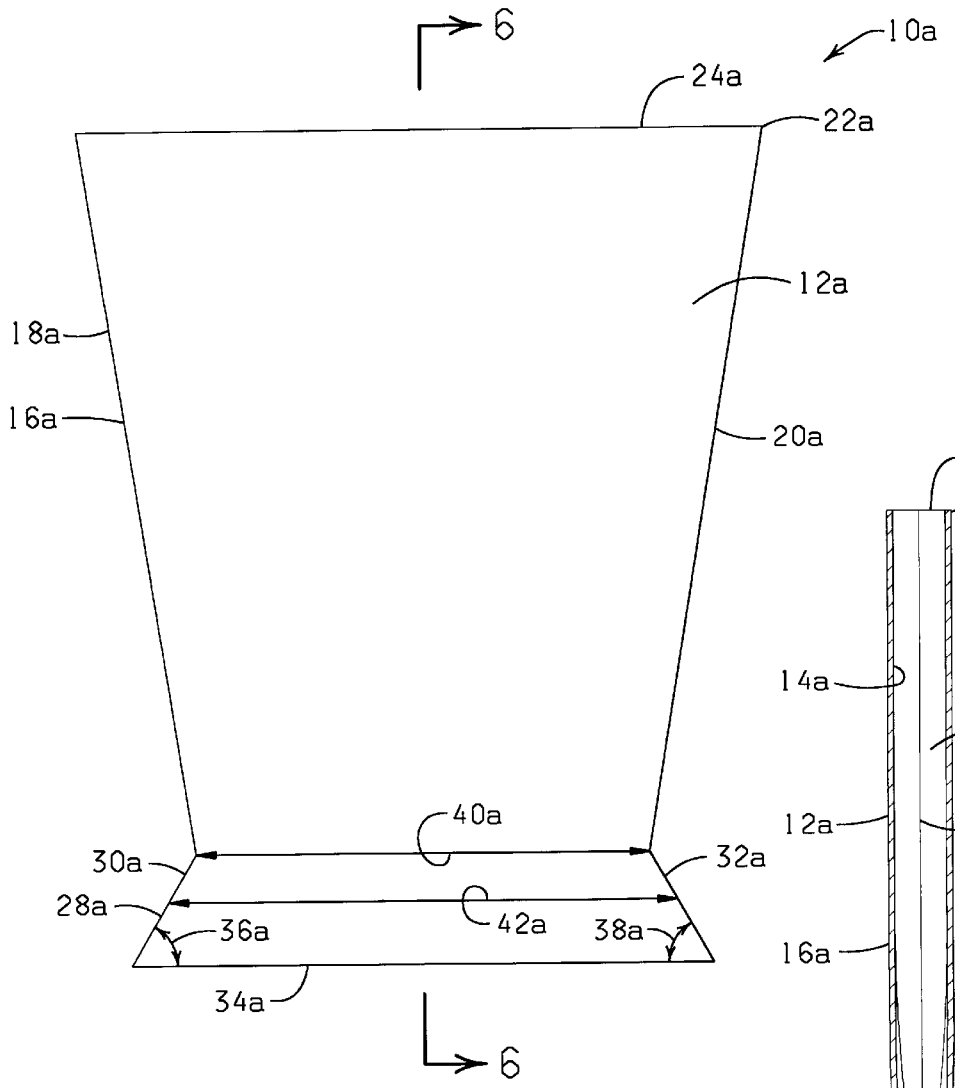
FIG. 5 is an elevational view of another embodiment of a sleeve constructed in accordance with the present invention.
Figure 6:
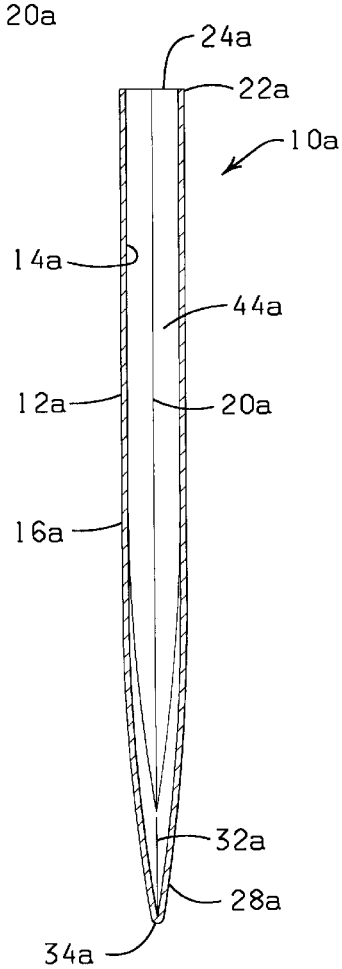
FIG. 6 is a cross-sectional view of the sleeve of FIG. 5 taken along line 6—6.

Shown in FIGS. 5–6 is a sleeve designated by the general reference numeral 10*a*. Sleeve 10*a* has an outer peripheral surface 12*a*, an inner peripheral surface 14*a*, a body 16*a*, a first sidewall edge 18*a*, a second sidewall edge 20*a*, an upper end 22*a* having an upper edge 24*a*, a trapezoidal lower end 28*a* and an inner space 44*a*. The trapezoidal lower end 28*a* has a first lower side edge 30*a*, a second lower side edge 32*a*, and a bottom edge 34*a*. The first lower side edge 30*a* forms a first angle 36*a* with the bottom edge 34*a* and the second lower side edge 32*a* forms a second angle 38*a* with the bottom edge 34*a*. The first angle 36*a* and the second angle 38*a* face each other and are each less than 90°. The sleeve 10*a* has a minimum width 40*a* in the body 16*a* thereof and a width 42*a* in the trapezoidal lower end 28*a* thereof. The minimum width 40*a* of the body 16*a* is less than the width 42*a* of the trapezoidal lower end 28*a*. Sleeve 10*a* is similar to sleeve 10 shown above except the upper edge 24*a* of the upper end 22*a* is linear rather than non-linear.

Figure 7:
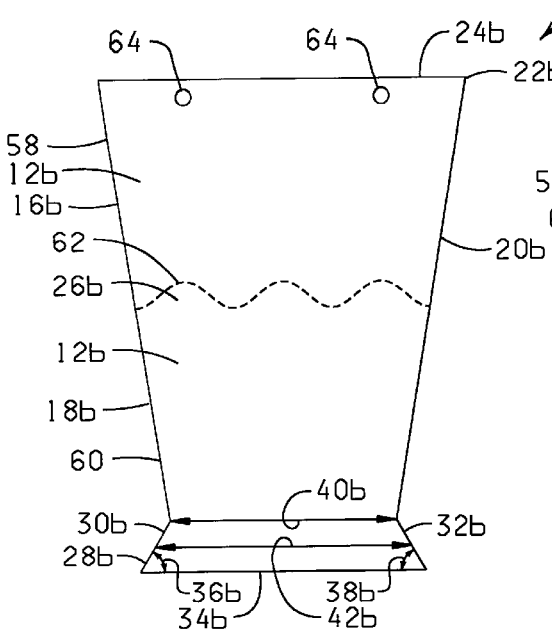
FIG. 7 is an elevational view of another embodiment of a sleeve constructed in accordance with the present invention.

Shown in FIG. 7 is a sleeve designated by the general reference numeral 10*b*. Sleeve 10*b* has an outer peripheral surface 12*b*, a body 16*b*, a first sidewall edge 18*b*, a second sidewall edge 20*b*, an upper end 22*b* having an upper edge 24*b*, a skirt portion 26*b*, and a trapezoidal lower end 28*b*. The trapezoidal lower end 28*b* has a first lower side edge 30*b*, a second lower side edge 32*b*, and a bottom edge 34*b*. The first lower side edge 30*b* forms a first angle 36*b* with the bottom edge 34*b* and the second lower side edge 32*b* forms a second angle 38*b* with the bottom edge 34*b*. The first angle 36*b* and the second angle 38*b* face each other and are each less than 90°. The sleeve 10*b* has a minimum width 40*b* in the body 16*b* thereof and a width 42*b* in the trapezoidal lower end 28*b* thereof. The minimum width 40 of the body 16 is less than the width 42*b* of the trapezoidal lower end 28*b*.

Sleeve 10*b* is basically similar to sleeves 10–10*a* shown in FIGS. 1–6 except sleeve 10*b* comprises both an upper portion 58 and a lower portion 60. The upper portion 58 is detachable from the lower portion 60 via a detaching element 62, such as perforations. The upper portion 58 generally is sized so that it can substantially surround the floral grouping 46 alone or disposed within the pot 52 disposed within the sleeve 10*b*. The upper portion 58 may have apertures 64 therein for enabling the sleeve 10*b* to be supported from a support device or assembly such as a wicket, in a manner well known to those of ordinary skill in the art.

Figure 8:
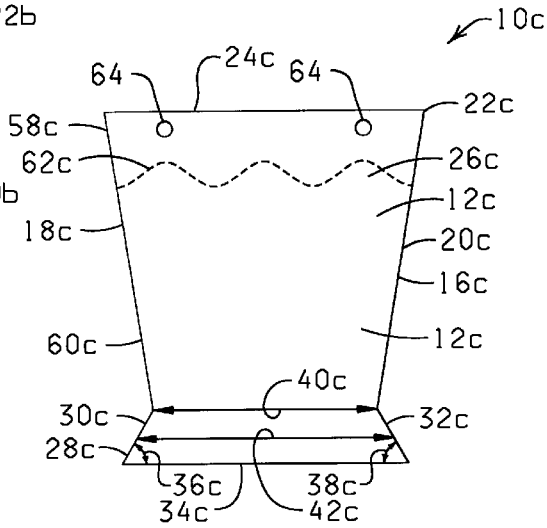
FIG. 8 is an elevational view of another embodiment of a sleeve constructed in accordance with the present invention.

Shown in FIG. 8 is a sleeve designated by the general reference numeral 10*c*. Sleeve 10*c* has an outer peripheral surface 12*c*, a body 16*c*, a first sidewall edge 18*c*, a second sidewall edge 20*c*, an upper end 22*c* having an upper edge 24*c*, a skirt portion 26*c*, and a trapezoidal lower end 28*c*. The trapezoidal lower end 28*c* has a first lower side edge 30*c*, a second lower side edge 32*c*, and a bottom edge 34*c*. The first lower side edge 30*c* forms a first angle 36*c* with the bottom edge 34*c* and the second lower side edge 32*c* forms a second angle 38*c* with the bottom edge 34*c*. The first angle 36*c* and the second angle 38*c* face each other and are each less than 90°. The sleeve 10*c* has a minimum width 40*c* in the body 16*c* thereof and a width 42*c* in the trapezoidal lower end 28*c* thereof. The minimum width 40*c* of the body 16*c* is less than the width 42*c* of the trapezoidal lower end 28*c*. Sleeve 10*c* is similar to sleeve 10*b* in having an upper portion 58*c*, a lower portion 60*c*, a detaching element 62*c*, and optionally apertures 64, but differs in that the upper portion 58*c* is designed to be removed from the lower portion 60*c* before the lower portion 60*c* is used to cover pot 52 or floral grouping 46, and further, the upper portion 58*c* is generally not sized to enclose the floral grouping 46.

Figure 9:
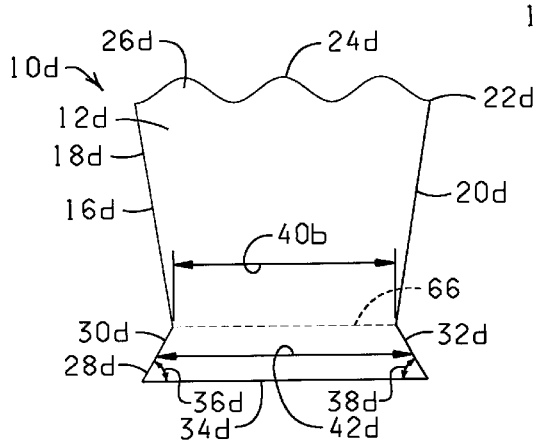
FIG. 9 is an elevational view of another embodiment of a sleeve constructed in accordance with the present invention.

Shown in FIG. 9 is a sleeve designated by the general reference numeral 10*d*. Sleeve 10*d* has an outer peripheral surface 12*d*, a body 16*d*, a first sidewall edge 18*d*, a second sidewall edge 20*d*, an upper end 22*d* having an upper edge 24*d*, a skirt portion 26*d*, and a trapezoidal lower end 28*d*. The trapezoidal lower end 28*d* has a first lower side edge 30*d*, a second lower side edge 32*d*, and a bottom edge 34*d*. The first lower side edge 30*d* forms a first angle 36*d* with the bottom edge 34*d* and the second lower side edge 32*d* forms a second angle 38*d* with the bottom edge 34*d*. The first angle 36*d* and the second angle 38*d* face each other and are each less than 90°. The sleeve 10 has a minimum width 40*d* in the body 16*d* thereof and a width 42*d* in the trapezoidal lower end 28*d* thereof. The minimum width 40*d* of the body 16*d* is less than the width 42*d* of the trapezoidal lower end 28*d*.

Sleeve 10*d* is similar to sleeves 10–10*c* described above except sleeve 10*d* has a gusset 66 in the trapezoidal lower end 28*d*. The gusset 66 further enables the trapezoidal lower end 28*d* to be expanded when the floral grouping 46 or pot 52 is disposed therein. Gussets and methods for constructing them are well known to persons of ordinary skill in the art, therefore further discussion of their methods of construction is not deemed necessary herein.

Figure 10:
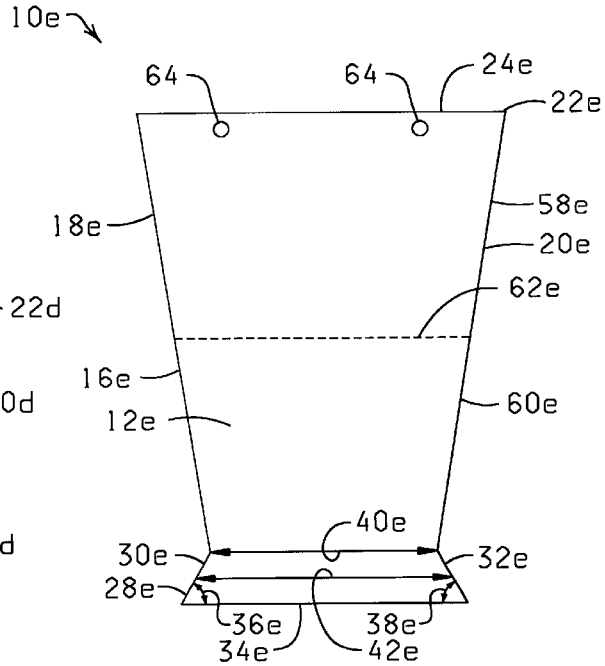
FIG. 10 is an elevational view of another embodiment of a sleeve constructed in accordance with the present invention.

Shown in FIG. 10 is a sleeve designated by the general reference numeral 10*e*. Sleeve 10*e* has an outer peripheral surface 12*e*, a body 16*e*, a first sidewall edge 18*e*, a second sidewall edge 20*e*, an upper end 22*e* having an upper edge 24*e*, and a trapezoidal lower end 28*e*. The trapezoidal lower end 28*e* has a first lower side edge 30*e*, a second lower side edge 32*e*, and a bottom edge 34*e*. The first lower side edge 30*e* forms a first angle 36*e* with the bottom edge 34*e* and the second lower side edge 32*e* forms a second angle 38*e* with the bottom edge 34*e*. The first angle 36*e* and the second angle 38*e* face each other and are each less than 90°. The sleeve 10*e* has a minimum width 40*e* in the body 16*e* thereof and a width 42*e* in the trapezoidal lower end 28*e* thereof. The minimum width 40*e* of the body 16*e* is less than the width 42*e* of the trapezoidal lower end 28*e*. Sleeve 10*e* is similar to sleeve 10*b* described above. Sleeve 10*e* has an upper portion 58*e*, a lower portion 60*e* and a detaching element 62*e* for detaching the upper portion 58*e* from the lower portion 60*e*. Sleeve 10*e* optionally has apertures 64 for enabling the sleeve 10*e* to be supported from a support device or assembly as previously described.

Sleeve 10*e* differs from sleeve 10*b* primarily in that the detaching element 62*e* has a linear or arcuate pattern extending from first sidewall edge 18*e* to second sidewall edge 20*e* rather than a non-linear pattern as shown for detaching element 62 of sleeve 10*b*.

Any of the sleeves contemplated herein may also be equipped with drainage elements (e.g., one or more holes) in the lower end 28–28*e* thereof or ventilation holes (not shown), or can be made from permeable or impermeable materials.

Any thickness of material may be utilized in accordance with the present invention as long as the sleeves may be formed as described herein, and as long as the formed sleeves may contain at least a portion of the pot 52 or floral grouping 46, as described herein. Additionally, an insulating material such as bubble film, preferable as one of two or more layers, can be utilized in order to provide additional protection for the item, such as the floral grouping 46, contained therein.

The material from which the sleeves 10–10*e* described herein are constructed preferably has a thickness in a range from about 0.1 mil to about 30 mils. Often, the thicknesses of the sleeves are in a range from about 0.5 mil to about 10 mils or preferably, in a range from about 1.0 mil to about 5 mils. More preferably, the sleeves 10–10*e* are constructed from a material which is flexible, semi-rigid, rigid, or any combination thereof. The sleeves 10–10*e* may be constructed of a single layer of material or a plurality of layers of the same or different types of materials. The layers of material comprising the sleeves 10–10*e* may be connected together or laminated or may be separate layers. Such materials used to construct the sleeves 10–10*e* are described in U.S. Pat. No. 5,111,637, which is hereby expressly incorporated herein by reference.

The sleeves 10–10*e* are constructed from any suitable material that is capable of being formed into a sleeve and wrapped about the pot 52 and the floral grouping 46 (or the floral grouping 46 alone) disposed therein. Preferably, the material comprises treated or untreated paper, metal foil, polymeric film, nonpolymeric film, woven or nonwoven fabric, or synthetic or natural fabric, cardboard, fiber, cloth, burlap, or laminations or combinations thereof.

In one embodiment, the sleeves 10–10*e* contemplated herein may be constructed from sheets comprising two polypropylene films. The two polypropylene films comprising the sleeves 10–10*e* may be connected together or laminated or may be separate layers. In an alternative embodiment, the sleeves 10–10*e* may be constructed from only one sheet of the polypropylene film.

The term "polymeric film" means a synthetic polymer such as a polypropylene or a naturally occurring polymer such as cellophane. A polymer film is relatively strong and not as subject to tearing (substantially non-tearable), as might be the case with paper or foil.

The materials comprising the sleeves 10–10*e* may vary in color and as described herein may consist of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination. Moreover, portions of the material used in constructing the sleeves 10–10*e* may vary in the combination of such characteristics. The material utilized for the sleeves 10–10*e* may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. As noted earlier, the floral grouping 46 comprises the bloom portion 50 and the stem portion 48. Further, the floral grouping 46 may comprise a growing potted plant having a root portion (not shown) as well. However, it will be appreciated that the floral grouping 46 may consist of only a single bloom or only foliage, or a botanical item, or a propagule. The term "floral grouping" may be used interchangeably herein with both the terms "floral arrangement". The term "potted plant" generally refers to the floral grouping 46 and the pot 52 along with a growing medium. The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as a bouquet or a floral grouping.

The term "propagule" when used herein means any structure capable of being propagated or acting as an agent of reproduction including seeds, shoots, stems, runners, tubers, plants, leaves, roots, or spores.

In accordance with the present invention a bonding material (not shown) may optionally be disposed on a portion of any of the sleeves 10–10*e* described herein to attach each sleeve 10–10*e* to the pot 52 having the floral grouping 46 therein and disposed within the sleeve 10–10*e*. The bonding material may alternatively be a band, tie, string, ribbon, wire, tape, heat shrinkable material or other tying or banding device which may be constructed within or attached to the sleeve 10–10*e* before it is applied about the pot or floral grouping or may be provided only after the sleeve 10–10*e* is applied about the pot or floral grouping. A separate bonding material may also assist in closing or sealing the upper portion (when present) of the sleeve 10–10*e* or in adhering the sleeve 10–10*e* to the pot after the pot has been disposed therein. Examples of how a bonding material may be disposed on the sleeve are shown in U.S. Pat. Nos. 5,493,809 and 5,625,979, both of which are hereby expressly incorporated herein by reference in their entirety.

The term "detaching element" when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

The upper portion 58, 58*c* or 58*e* of the sleeves 10*b*, 10*c* and 10*e*, respectively, may also have an additional substantial vertically disposed detaching element comprising a plurality of vertical perforations (not shown but well known in the art) for facilitating removal of the upper portion 58, 58*c* or 58*e* thereof from the lower portion 60, 60*c* or 60e, respectively.

As indicated above, it will be understood by a person of ordinary skill in the art that equipment and devices for forming floral sleeves are commercially available, and are well known to a person of ordinary skill in the art. Further detailed discussion of the construction of the sleeves described herein therefore is not deemed necessary. However, briefly, the sleeves described herein may be formed by intermittently advancing two separate webs, one or two webs preformed in the form of a tube, or a single web folded double and sealing the longitudinal sides and bottom portions of the two facing panels then cutting the sleeve thus formed from the webs or web. Machines which can form sleeves from such single webs or pairs of webs are well within the knowledge of one of ordinary skill in the art.

As noted above, any of the sleeves 10–10*e* contemplated herein may have lower end 28–28*e* which are open or closed. When the lower end 28–28*e* is closed, the lower end

28–28*e* may have one or more gussets 66 as described elsewhere herein formed therein for allowing expansion of the lower end 28–28*e* when an object with a broad lower end such as the pot 52 is disposed therein. In another version, the sleeve 10–10*e* may comprise a flap (not shown) which can be folded over and sealed with a bonding material to close the sleeve 10–10*e*.

The term "pot" or "flower pot" as used herein refers to any type of container used for holding a floral grouping or plant, including vases. Examples of pots, used in accordance with the present invention include, but not by way of limitation, clay pots, wooden pots, foam pots, plastic pots, pots made from natural and/or synthetic fibers, and/or any combination thereof. The pot 52 is adapted to receive the floral grouping 46 in a retaining space thereof. The floral grouping 46 may be disposed within the pot 52 along with a suitable growing medium described elsewhere herein, or other retaining medium, such as a floral foam. It will also be understood that the floral grouping 46, and any appropriate growing medium or other retaining medium, may be disposed in the sleeve 10–10*e* without the pot 52 for cultivating the floral grouping 46 or displaying a grown floral grouping 46 or botanical item.

It should also be noted that for all versions of sleeves described above which have a bonding material thereon, it may be desirable to have a release material or cover strip covering the adhesive or cohesive bonding material disposed on any portion of such sleeves for preventing the bonding material from bonding to another surface until such is desired. Further, in each of the cases described herein wherein a sleeve 10–10*e* is applied to the pot 52, the sleeve 10–10*e* may be applied thereto either by depositing the pot 52 downwardly into the opened sleeve 10–10*e*, or the sleeve 10–10*e* may be brought upwardly about the pot 52 from below the pot 52.

It should be further noted that various features of the versions of the present invention such as closure bonding areas, support apertures, handles or handle apertures, additional perforations, drainage elements, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

What is claimed is:

1. A sleeve having a flattened condition and openable therefrom, comprising:

a body, an outer peripheral surface, an inner peripheral surface, an inner space, a first sidewall edge, a second sidewall edge, an upper end having an upper edge, a trapezoidal lower end having a first lower side edge, a second lower side edge, and a bottom edge, and wherein the first lower side edge forms a first angle with the bottom edge, and the second lower side edge forms a second angle with the bottom edge, and wherein the first angle and the second angle face each other and are each less than 90°.

2. The sleeve of claim 1 wherein the first angle and the second angle are each in a range of from about 85° to about 5°.

3. The sleeve of claim 1 wherein the first angle and the second angle are each in a range of from about 80° to about 10°.

4. The sleeve of claim 1 wherein the first angle and the second angle are each in a range of from about 75° to about 15°.

5. The sleeve of claim 1 wherein the first angle and the second angle are each in a range of from about 70° to about 20°.

6. The sleeve of claim 1 wherein the first angle and the second angle are each in a range of from about 65° to about 25°.

7. The sleeve of claim 1 wherein the first angle and the second angle are each in a range of from about 60° to about 30°.

8. The sleeve of claim 1 wherein the first angle and the second angle are each in a range of from about 55° to about 35°.

9. The sleeve of claim 1 wherein the first angle and the second angle are each in a range of from about 50° to about 40°.

10. The sleeve of claim 1 wherein the first angle and the second angle are each in a range of from about 48° to about 42°.

11. The sleeve of claim 1 wherein the body has a generally frustoconical shape when opened from the flattened condition.

12. The sleeve of claim 1 further comprising a gusset in the trapezoidal lower end.

13. The sleeve of claim 1 further comprising a skirt portion.

14. The sleeve of claim 1 wherein the upper edge of the upper end is non-linear.

15. The sleeve of claim 1 wherein the upper edge of the upper end is linear or arcuate.

16. The sleeve of claim 1 wherein the body further comprises an upper portion, a lower portion and a detaching element for detaching the upper portion form the lower portion.

17. The sleeve of claim 16 wherein the detaching element comprises perforations.

18. The sleeve of claim 16 wherein the detaching element has a non-linear pattern such that when the upper portion is detached from the lower portion, the lower portion is left with an upper end having a non-linear upper edge.

19. The sleeve of claim 16 wherein the detaching element has a linear or arcuate pattern such that when the upper portion is detached from the lower portion, the lower portion is left with an upper end having a linear or arcuate upper edge.

20. The sleeve of claim 1 wherein the upper portion is sized to substantially surround and enclose a floral grouping.

21. The sleeve of claim 1 wherein the upper portion is adapted to support the sleeve from a support assembly.

22. The sleeve of claim 1 further comprising a minimum width of the body and a width of the trapezoidal lower end, wherein the minimum width of the body is less than the width of the trapezoidal lower end.

23. A sleeve having a flattened condition and openable therefrom, comprising:

a body, an outer peripheral surface, an inner peripheral surface, an inner space, a first sidewall edge, a second sidewall edge, an upper end having an upper edge, a trapezoidal lower end having a first lower side edge, a second lower side edge, and a bottom edge, and wherein the first lower side edge forms a first angle with the bottom edge, and the second lower side edge forms a second angle with the bottom edge, and wherein the first angle and the second angle face each other and are each less than 90°, and the sleeve further having a detaching element extending across the body for detaching an upper portion of the body from a lower portion of the body.

24. The sleeve of claim 23 wherein the first angle and the second angle are each in a range of from about 85° to about 5°.

25. The sleeve of claim 23 wherein the first angle and the second angle are each in a range of from about 80° to about 10°.

26. The sleeve of claim 23 wherein the first angle and the second angle are each in a range of from about 75° to about 15°.

27. The sleeve of claim 23 wherein the first angle and the second angle are each in a range of from about 70° to about 20°.

28. The sleeve of claim 23 wherein the first angle and the second angle are each in a range of from about 65° to about 25°.

29. The sleeve of claim 23 wherein the first angle and the second angle are each in a range of from about 60° to about 30°.

30. The sleeve of claim 23 wherein the first angle and the second angle are each in a range of from about 55° to about 35°.

31. The sleeve of claim 23 wherein the first angle and the second angle are each in a range of from about 50° to about 40°.

32. The sleeve of claim 23 wherein the first angle and the second angle are each in a range of from about 48° to about 42°.

33. The sleeve of claim 23 wherein the body has a generally frustoconical shape when opened from the flattened condition.

34. The sleeve of claim 23 further comprising a gusset in the trapezoidal lower end.

35. The sleeve of claim 23 further comprising a skirt portion.

36. The sleeve of claim 23 wherein the detaching element comprises perforations.

37. The sleeve of claim 23 wherein the detaching element has a non-linear pattern such that when the upper portion is detached from the lower portion, the lower portion is left with an upper end having a non-linear upper edge.

38. The sleeve of claim 23 wherein the detaching element has a linear or arcuate pattern such that when the upper portion is detached from the lower portion, the lower portion is left with an upper end having a linear or arcuate upper edge.

39. The sleeve of claim 23 wherein the upper portion is sized to substantially surround and enclose a floral grouping.

40. The sleeve of claim 23 wherein the upper portion is adapted to support the sleeve from a support assembly.

41. The sleeve of claim 23 further comprising a minimum width of the body and a width of the trapezoidal lower end, wherein the minimum width of the body is less than the width of the trapezoidal lower end.

* * * * *